US005275027A

United States Patent [19]

Eklof et al.

[11] Patent Number: 5,275,027

[45] Date of Patent: Jan. 4, 1994

[54] SECURITY DEVICE FOR MERCHANDISE DISPLAY HOOKS

[75] Inventors: Thomas E. Eklof; Walter M. Poterbin; Roger L. Fernandez, all of Santa Cruz, Calif.

[73] Assignee: Santa Cruz Industries, Santa Cruz, Calif.

[21] Appl. No.: 899,654

[22] Filed: Jun. 16, 1992

[51] Int. Cl.[5] ..... E05B 73/00

[52] U.S. Cl. ..... 70/14; 70/38 A; 70/39; 70/49; 70/58; 70/65; 211/4; 292/19; 292/320

[58] Field of Search ..... 70/38; 292/19, 20, 288, 292/320, DIG.; 211/4, 7, 57.1, 59.1

[56] References Cited

U.S. PATENT DOCUMENTS

| | | | |
|---|---|---|---|
| 1,022,980 | 4/1912 | Stringer . | |
| 1,206,769 | 11/1916 | Wheary . | |
| 1,432,589 | 10/1922 | Brazeau | 211/7 |
| 2,946,269 | 7/1960 | Maiershofer | 292/19 X |
| 3,275,160 | 9/1966 | Zürker | 211/4 X |
| 3,655,061 | 4/1972 | Peschcke-Koedt | 211/57 |
| 4,289,242 | 9/1981 | Kenyon | 211/4 |
| 4,462,497 | 7/1984 | Maule | 211/7 |
| 4,500,120 | 2/1985 | Ridgewell et al. | 292/19 |
| 4,547,006 | 10/1985 | Castanier | 292/DIG. 72 X |
| 4,953,371 | 9/1990 | Appelbaum | 70/417 X |
| 5,027,622 | 7/1991 | Hatch et al. | 70/14 |
| 5,060,810 | 10/1991 | Jones | 211/4 X |

FOREIGN PATENT DOCUMENTS

| | | | |
|---|---|---|---|
| 107769 | 2/1899 | Fed. Rep. of Germany | 211/4 |
| 127965 | 2/1902 | Fed. Rep. of Germany | 211/4 |
| 68738 | 5/1915 | Fed. Rep. of Germany | 211/4 |
| 2550930 | 3/1985 | France | 211/4 |
| 1334 | of 1901 | United Kingdom | 211/4 |
| 2240578 | 8/1991 | United Kingdom | 70/49 |

*Primary Examiner*—Lloyd A. Gall
*Attorney, Agent, or Firm*—Flehr, Hohbach, Test, Albritton & Herbert

[57] ABSTRACT

A security device is provided for use on pegboard type hooks. The device includes a housing with a lock mechanism which releasably locks with the tines of a latch to securely grip the rod of the pegboard hook. A simple key-operated camming cylinder is manually operated to release the latch so that merchandise products carried on hook can be removed. The latch can be inserted into the housing and relocked on the hook without using the key.

9 Claims, 5 Drawing Sheets

SECURITY DEVICE FOR MERCHANDISE DISPLAY HOOKS

BACKGROUND OF THE INVENTION

1. Field of the Invention

This invention relates to merchandise display apparatus of the type in which products are carried on hooks attached to pegboards or other supports. Pegboard and hook assemblies of this type are typically used in retail stores and supermarkets for providing an attractive display of relatively small merchandise products. The products are usually packaged on card stock punched with holes for mounting on the hooks.

While pegboard type racks provide a uniform and attractive display for enhancing sales, the products are subject to shoplifting and pilfering. The relatively small size products typically displayed on pegboard racks can be easily removed and pilfered. This can result in considerable monetary loss to the retailer, especially where the products are expensive.

2. Background Art

The prior art efforts to minimize pilferage from pegboard type displays have resulted in relatively complicated locking mechanisms which are expensive and cumbersome to use. Among this prior art is U.S. Pat. No. 5,027,622 which provides a key-operated lock that holds a cover plate in place about a pegboard rod. A special key must be carried by the store clerk both to open and close the device. U.S. Pat. No. 3,655,061 provides an anti-theft device for a pegboard hook, but it requires a special design for the product packaging, which is undesirably expensive and limits its range of use. U.S. Pat. No. 1,022,980 provides a locking device for use with a clothes hanger, but requires a special key for both opening and closing the device. U.S. Pat. No. 1,206,769 shows another key-operated locking arrangement in which a special key is required for both opening and closing.

The need has therefore been recognized for a new and improved security device for displaying merchandise products on pegboard type hooks which is relatively simple in construction, inexpensive to manufacture, can be easily unlocked with a simple key and can be repidly relocked on the hook without the need for a key.

OBJECTS AND SUMMARY OF THE INVENTION

It is a general object of the present invention to provide a new and improved security device for releasably securing merchandise products on a pegboard type hook for minimizing pilferage and theft.

Another object is to provide a security device of the type described which employs a relatively few number of parts that can be inexpensively fabricated from synthetic plastic materials and which provides a strong lock on the end portion of the hook to secure the merchandise products against unauthorized removal.

Another object is to provide a security device of the type described which can be easily unlocked by a lightweight and simple key carried by the store clerk, and in which the device can be relocked on the hook without using a key.

Another object is to provide a security device of the type described which can be universally used for securing double rod safety hooks of a range of rod diameters.

The invention in summary provides a security device which includes a housing that carries a pad for engaging the side of a rod of a pegboard type hook. A latch with a pair of spaced-apart tines slides through an opening in the housing to a fully-inserted position where a bar on the latch captures the rod against the pad. A lock structure within the housing releasably locks the tines when the latch is fully inserted. A key-operated lock release mechanism unlocks the tines to enable withdrawal of the latch from the housing. This releases the rod and permits the device to be removed so that one or more of the products can be withdrawn from the hook. The device is reinstalled on the hook without the need of a key by pushing the latch into the opening until a detent mechanism engages the tines. In one embodiment the security device is adapted for use with a single rod pegboard type hook, and in another embodiment the device is adapted for use with a safety hook having a pair of rods.

The foregoing and additional objects and features of the invention are set forth in more detail in the following description in which the several embodiments have been explained in conjunction with the accompanying drawings.

DESCRIPTION OF THE PREFERRED EMBODIMENTS

Figure 1:
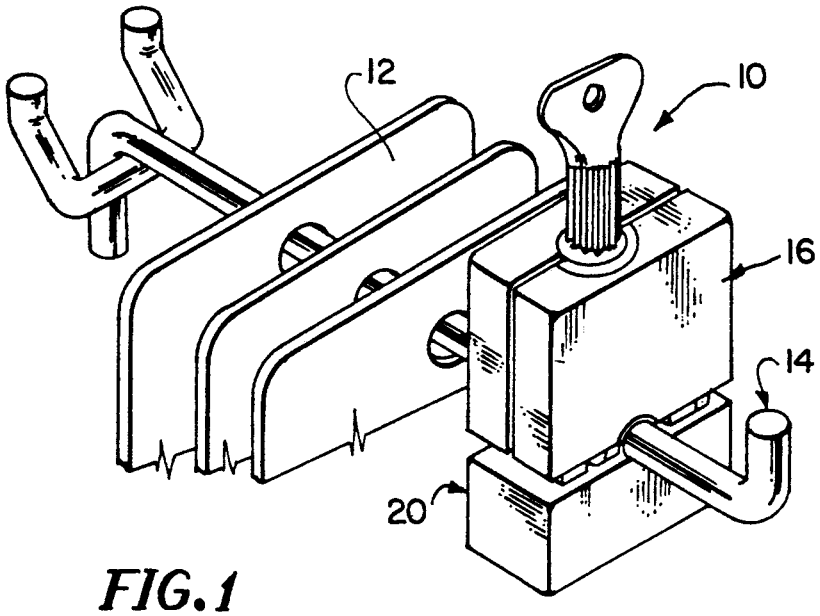
FIG. 1 is a perspective view illustrating a security device according to one embodiment of the invention and which is shown in locked position on a typical pegboard hook.

In the drawings FIGS. 1-9 illustrate generally at 10 a security device providing one embodiment for releasably securing merchandise products 12 onto a hook 14 mounted on a pegboard or other suitable support, such as a wire grid or wire slot (not shown). The products to be displayed are typically small merchandise items of the type sold in retail stores or supermarkets. The products are usually carried on card stock having holes or apertures punched at the top for spindling on the hooks. The products, with or without the card stock, can be encased in a clear plastic enclosure, such as a plastic blister pack or clamshell package. As used herein, the term "products" means merchandise items which can be mounted on pegboard hooks with or without packaging.

As best illustrated in FIGS. 3-7, security device 10 is comprised of a housing 16 having an opening 18 at its lower end through which a latch 20 is upwardly inserted. A manually-operated key 22 is provided for insertion into the keyway 24 (FIG. 9) of a lock release mechanism 26 which is mounted at the top end of the housing.

The housing is comprised of a pair of half-shells 28, 30 of rectangular configuration which are adapted to join together along their facing edges 32 in a tamper-proof fit. A molded guide 34 is fitted within the inner cavity of the housing. A detent carrier body 36 is molded as a part of the lower end of housing half-shell 30, and a pair of passageways 38, 40 (FIG. 6) are formed along opposite sides of the carrier body for receiving the latch. A pair of triangular-shaped nibs 42, 44 are integrally formed on opposite sides of the carrier body, with the nibs extending into the passageways to provide detents for releasably securing the latch in the fully inserted position illustrated in FIG. 4.

Figure 4:
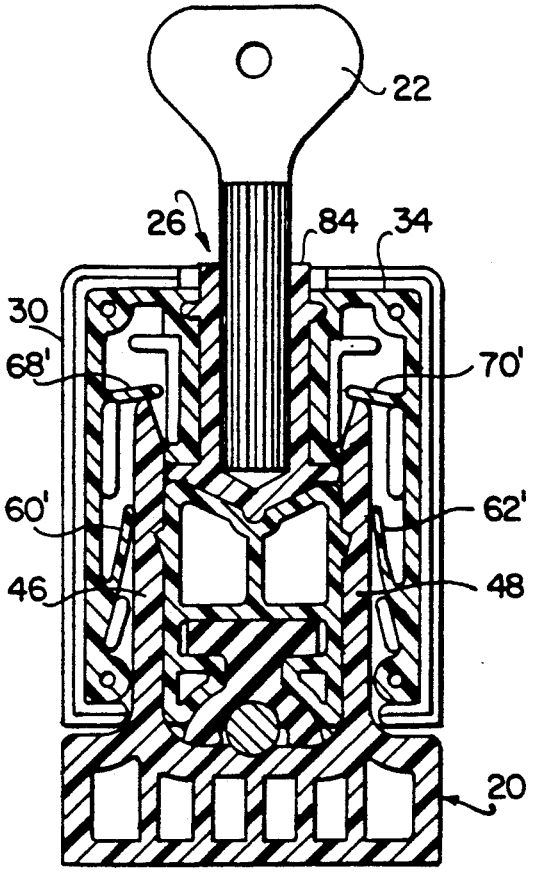
FIG. 4 is a cross-sectional view taken along the line 4—4 of FIG. 3 showing components of the security device in their fully locked positions.

Latch 20 is formed with a pair elongate spaced-apart tines 46, 48 which are sized commensurate with the passageways 38 and 40. The base portion of the latch at the proximal ends of the tines forms a capture bar 50 for seating against a side of the hook rod 52. A semi-circular cutout 54 is formed at the midspan of the capture bar to partially seat the rod. The tines and capture bar of the latch are integrally molded of a suitable resilient flexible material, such as Nylon ®, which is a trademark for a thermoplastic polyamide. This permits the tines to resiliently flex apart or together. A pair of notches 56 and 58, commensurate in size and shape to nibs 42 and 44, are formed on the inner sides of the tines at positions which match the nibs when the latch is in its fully inserted position. With the latch fully inserted the nibs interlock with the notches (FIG. 4). The nibs and notches are shaped so that their flat surfaces lie toward the tine ends to provide solid resistance against withdrawal of the latch from its fully inserted position.

Figure 5:
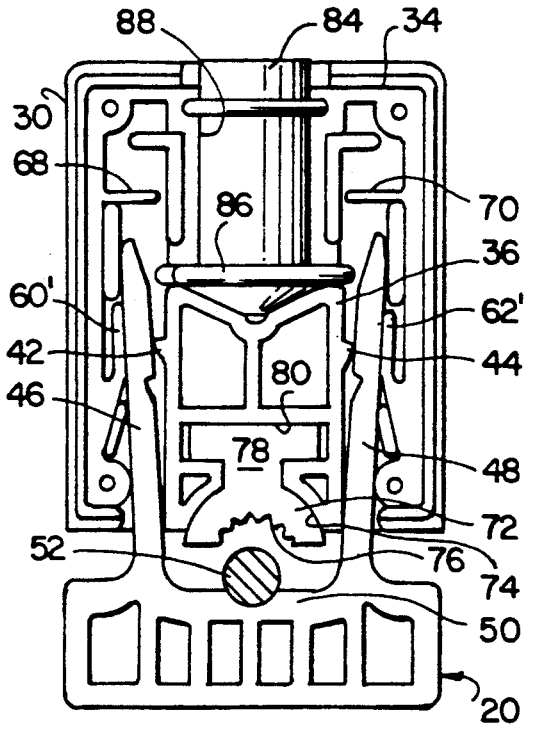
FIG. 5 is fragmentary view of the security device of FIG. 1 with a portion of the housing removed showing the latch component unlocked and partially withdrawn.

Guide 34 is molded with a pair of fingers 60, 62 which project inwardly and upwardly into the paths of movement of the tines through the passageways. The guide and fingers are formed of a suitable resilient flexible material, such as Nylon ®. When the latch is inserted the front ends of the tines push against the tips of the fingers, which are resiliently bent outwardly to the positions 60' and 62' (FIG. 5). The elastic memory of the fingers applies an inward force which is sufficient to push the tines inwardly when the notches are moved into alignment with the detent nibs. Bevel surfaces 64, 66 are formed on the inner edges of the distal ends of the tines so that when the latch is pushed in the bevels strike the inclined surfaces of the nibs and cam the tines outwardly.

Two inwardly extending arms 68, 70 are formed in the upper portion of the guide at positions where they lie in an interference fit with the distal ends of the tines when the latch is fully inserted. When fully inserted, the tines push against these arms which are resiliently bent upwardly through short angles to the cocked positions 68', 70' shown in FIG. 4. The elastic memory of the arms applies a downward force against the tines, and when the tines are unlocked this force pushes the latch downwardly a short distance for initially releasing it from the housing. The latch can then be manually withdrawn from the housing.

Means for engaging the rod is provided and comprises a pad 72 which is removably mounted in a seat 74 formed in the lower end of the housing. The lower end of the pad has a semi-circular gripping surface 76 which faces downwardly through the housing opening. The upper end of the pad is formed with a T-shaped head 78 which is adapted to slide into a corresponding T-shaped key slot 80 in the guide. The pad is made of a suitable resiliently deformable material having a surface which frictionally grips the metal surface of rod 52. The synthetic polymer sold under the trademark Krayton is suitable for this purpose. A plurality of parallel grooves 82 are formed along the gripping surface to provide additional gripping action when the rod is pressed upwardly against the pad. The removability feature permits interchange of pads having gripping surfaces of different curvatures for accommodating a range of peg hook sizes. The typical hook sizes are 0.125", 0.188" and 0.250". Three interchangeable pads can be provided, each of which would have a gripping surface with one of those size curvatures.

Lock release mechanism 26 is provided for selectively unlocking the tines. It comprises a cylinder 84, best shown in FIGS. 8 and 9, formed at its lower end with a rim 86 which is shaped to define a cam track. The cylinder is mounted for rotation about its central axis within a semi-circular cavity 88 formed at the upper end of guide 34. A corresponding semi-circular cavity, not shown, is formed internally within the upper end of housing portion 28 to support the opposite side of the cylinder.

The cam track of rim 86 is comprised of a pair of diametrically opposed, outwardly spiralling cam surfaces 90 and 92. The radii at the minimum rise of the cam surfaces, shown at points A and A' in FIG. 9, substantially match the distances to the inner edges of the tines when they are fully inserted and locked as shown in FIG. 4. The cam surfaces at their maximum radii, shown at points B and B' in FIG. 9, act against the tines and bend them outwardly to the position shown at 48' in FIG. 7 where the notches clear the detent nibs. Rotation of the cylinder through approximately 60° in either direction causes the cam surfaces to move relative to the tines between the minimum and maximum rise positions.

The keyway 24 is provided in cylinder 84 by means of an axial bore with parallel notches 94 formed around the bore's inner circumference. Key 22 has a shaft formed with parallel ribs 96 commensurate in size and shape with the bore notches. With the shaft of the key inserted into the keyway, it can be manually rotated back and forth through the 60° arc for operating the cam track between its locking and unlocking positions.

Figure 2:
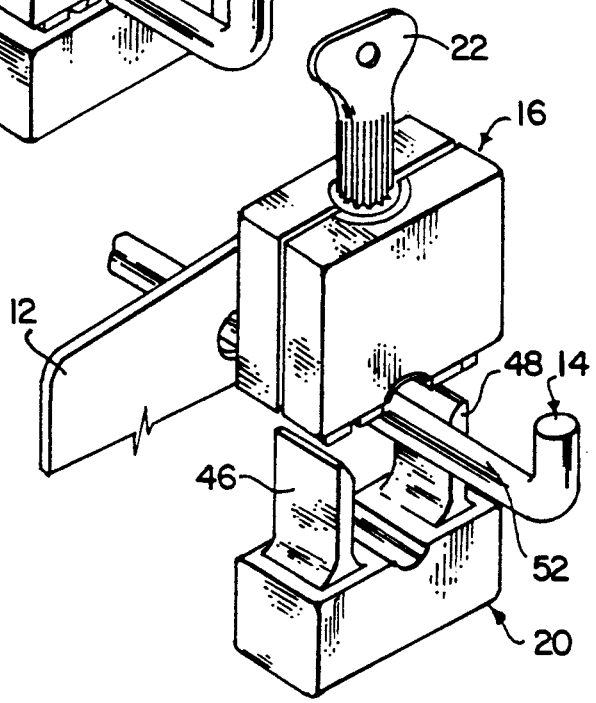
FIG. 2 is a perspective view similar to FIG. 1 showing components of the security device in their unlocked positions.
Figure 3:
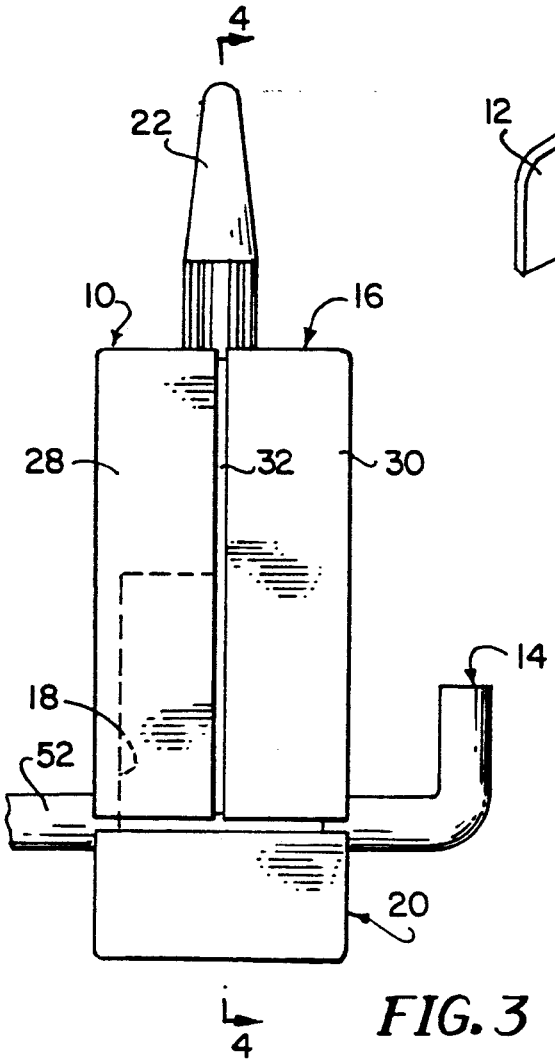
FIG. 3 is a side elevational view to an enlarged scale of the security device shown in FIG. 1.
Figure 6:
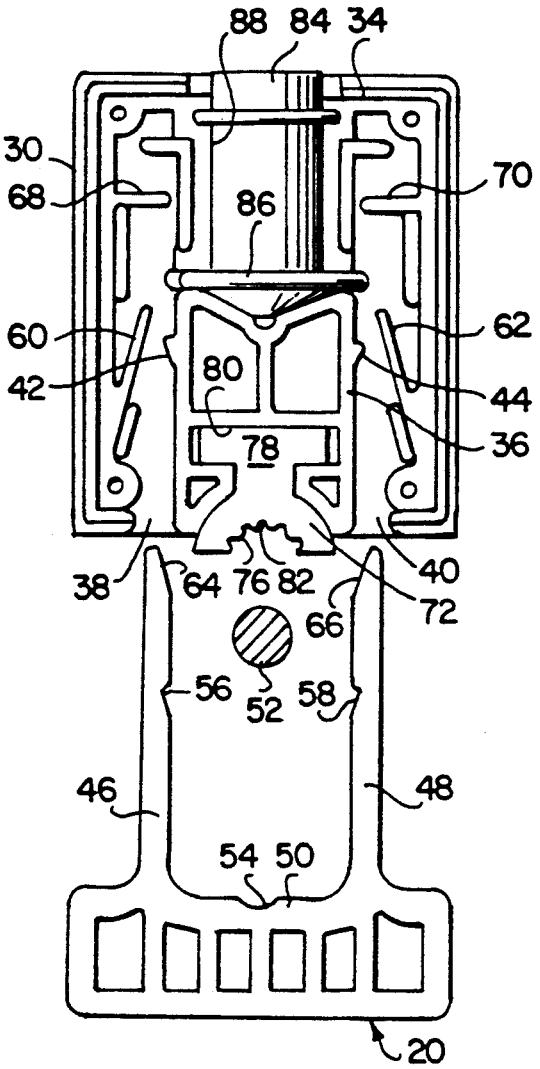
FIG. 6 is a view similar to FIG. 5 showing the latch component fully withdrawn.
Figure 7:
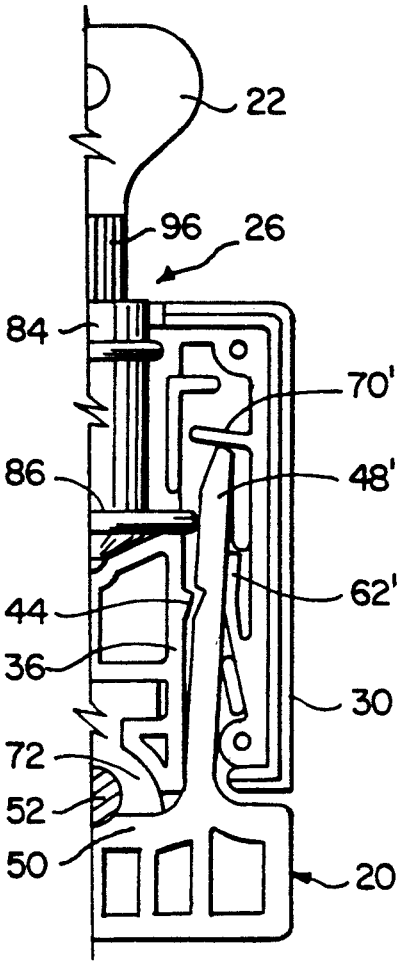
FIG. 7 is a partial view similar to FIG. 5 showing camming action of the lock release mechanism on the latch.
Figure 8:
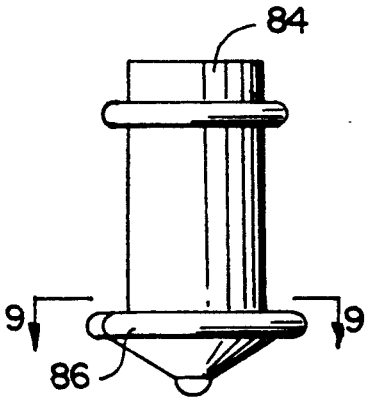
FIG. 8 is a fragmentary view showing the barrel of the lock release mechanism of the security device.
Figure 9:
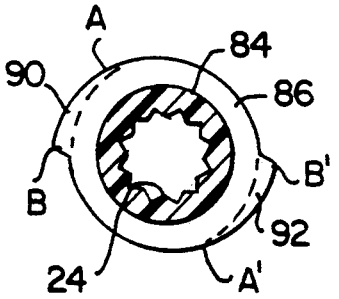
FIG. 9 is a cross-sectional view taken along the line 9—9 of FIG. 8.
Figure 10:
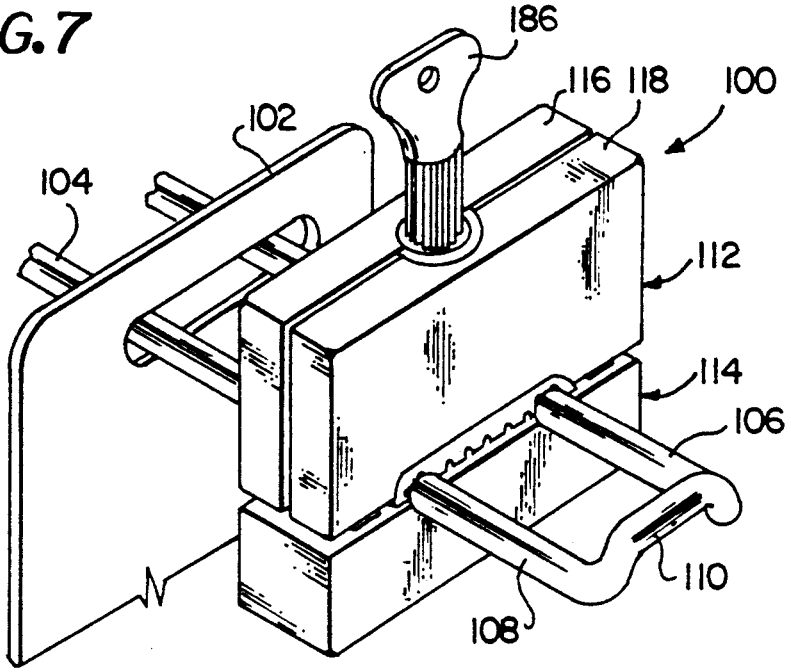
FIG. 10 is a perspective view illustrating the security device according to another embodiment showing it locked on a safety hook of the type having a pair of rods.

In the operation of security device 10, the first step in installing it is when the store clerk holds housing 16 above hook rod 52 with latch 20 aligned below the rod in the manner shown in FIGS. 2 and 6. The latch is then pushed upwardly so that the tines entering the passageways through the lower end of the housing. The tines are cammed outwardly as the tine beveled surfaces 64 and 66 strike the inclined surfaces of detent nibs 42, 44. The outward movement of the tines caused by this camming action also flexes fingers 60 and 62 outwardly. Upward movement of the latch continues until the tine notches come into alignment with the nibs. The tines are enabled to snap inwardly to the fully locked positions when cylinder 84 is turned to where the cam tracks are at or near their locking positions, which is where points A and A' on the cam tracks are aligned with the tines. The forces applied by the elastic memory of fingers 60, 62 urges the tines inwardly so that the notches automatically snap in place about the detent nibs. At this point the upper tips of the tines bend flexible arms 68 and 70 upwardly to their cocked positions. As latch 20 moves toward its fully inserted position, the semi-circular notch 54 in capture bar 50 seats against the lower surface of the rod, while the upper surface of the rod is forced against pad gripping surface 76. When fully inserted and locked, the gripping forces between the capture bar and pad are sufficient to securely hold the device in its upright position on the hook. This locking procedure is carried out without operating the key. The latch can even be fully inserted and locked without the key being in the keyway, as long as the cam surfaces are moved away from their unlocking positions.

When it is desired to remove one or more of the products from the hook, the store clerk inserts key 22 into the keyway of cylinder 84. As the key is turned the cam surfaces begin rotating toward their unlocking positions until points B and B' on the cam tracks are aligned with the tines. When the camming action spreads the tines apart sufficient so that the notches clear the detent nibs in the position shown in FIG. 7, the downward forces applied by the elastic memory of arms 68 and 70 is sufficient to move the latch an initial distance out of the housing. This action also releases the pad and capture bar from the hook. The latch can then be fully withdrawn from the housing, permitting the clerk to remove one or more of the products.

FIGS. 10–16 illustrate a safety device 100 providing an embodiment for use in securing products 102 on a safety hook 104 of the type having a pair of laterally spaced-apart rods 106, 108 which are joined at their distal ends by an upturned curved end 110. The proximal end of the safety hook is adapted to mount on a pegboard, wire grid or slot wall, not shown.

Safety device 100 is comprised of a housing 112 and latch 114 which are adapted to releasably fit together in a manner similar to that described for the embodiment of FIGS. 1–9. The housing is comprised of a pair of half-shells 116, 118 which fit together and enclose a molded guide 120. Latch 114 is comprised of a capture bar 122 molded integrally with a pair of tines 124, 126 which are spaced apart a distance greater than the width of the two safety hook rods. The tines are adapted to be inserted into the lower opening 128 of the housing and through corresponding passageways 130 to their fully inserted position shown in FIG. 12. The tines are formed with notches 132, 134 which are sized to engage corresponding detent nibs 135, 136 formed on a detent carrier 138. Resilient fingers 140, 142 molded integral with the sides of the guide flex outwardly when the tines are inserted and function to push the tines inwardly so that the notches automatically engage the detent nibs in a manner similar to that described for the embodiment of FIGS. 1–9. A pair of arms 144, 146 molded on the guide are positioned in interference fits with the tine tips and function to push the latch downwardly when the lock is released in a manner similar to that described for the embodiment of FIGS. 1–9.

Lock release means is provided and includes a cylinder 148 mounted for rotation about a central axis within a semi-circular cavity 150 formed at the upper end of guide 120. A rim 152 at the lower end of the cylinder defines a cam track comprising diametrically opposed, outwardly spiralling cam surfaces 154 which preferably are sized and shaped similar to the cam surfaces described for the embodiment of FIG. 9.

Means is provided for camming the tines responsive to movement of the cam track and comprises a pair of T-shaped springs 156, 158 which act as cam followers. Spring 158 is typical of the pair and is shown in detail in FIG. 16. The spring is formed of a flat body 160 and a pair of outwardly extending wings 162, 164 which are molded integral with the body. The spring body is mounted in a sliding fit along a channel 166 formed by a pair of spaced-apart walls 168, 170 which are molded in guide 120. The wings are captured in respective U-shaped recesses 172, 174 in the walls. The pair of wings are molded so that, in their un-tensioned state, they incline at an acute angle of approximately 70° with respect to the spring body, as shown in the broken line position of FIG. 16. The spring body and wings are molded of a suitable flexible resilient material, such as Nylon®, so that when the spring body is cammed outwardly the wings flex within the recesses to the 90° position shown in solid line in FIG. 16.

Figure 12:
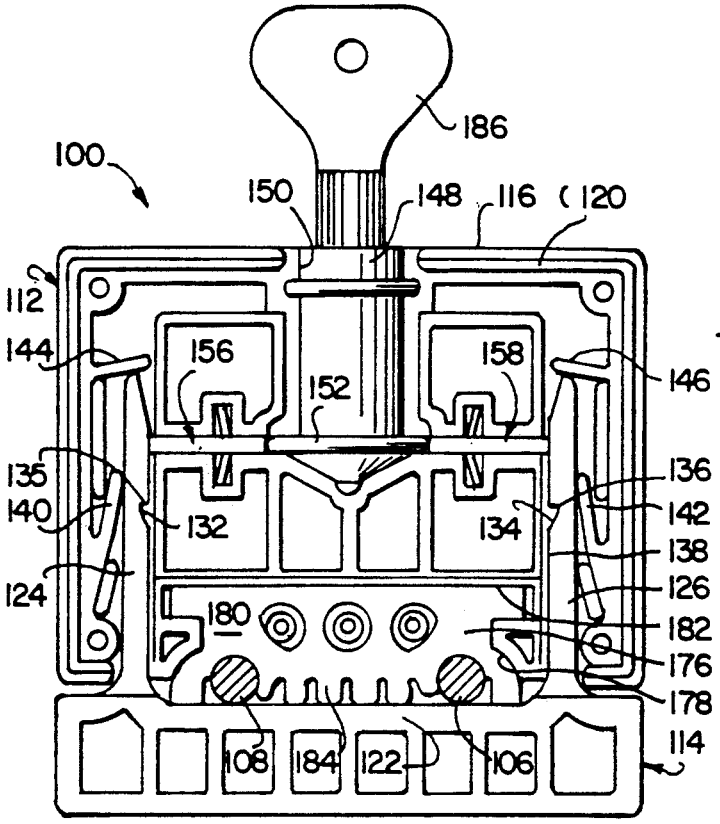
FIG. 12 is a partial view of the security device of FIG. 11 showing a component of the housing removed and with the components in their fully locked positions.
Figure 14:
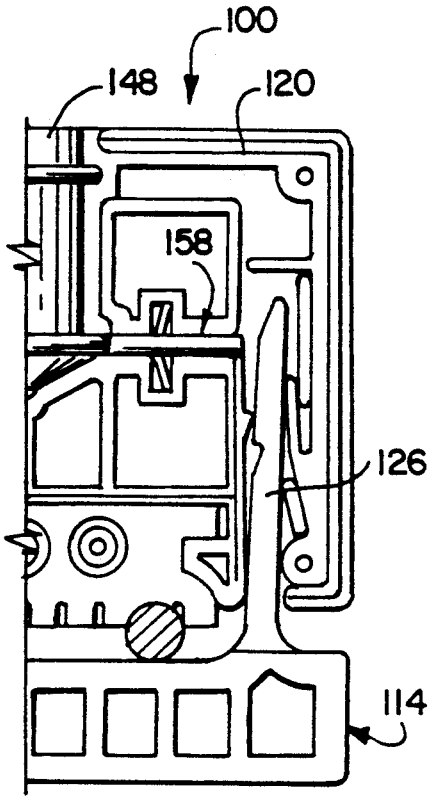
FIG. 14 is a fragmentary view of the security device of FIG. 12 showing the latch in its partially inserted position.
Figure 15:
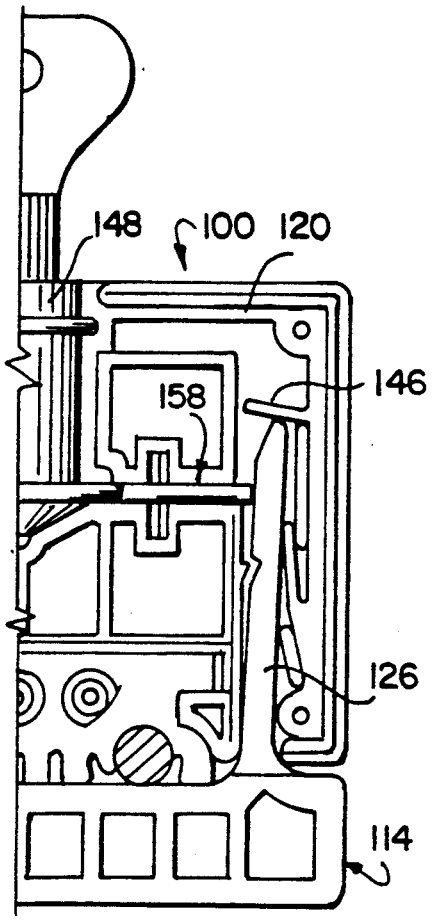
FIG. 15 is a view similar to FIG. 14 showing the camming action for releasing the latch.
Figure 16:
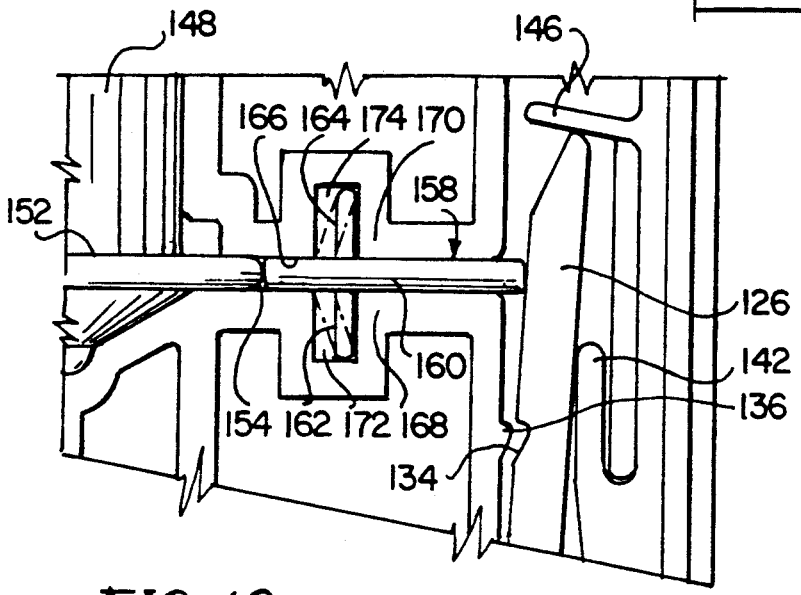
FIG. 16 is a fragmentary enlarged view illustrating the camming action of the lock release mechanism in the device of FIG. 15.

A pad 176 is mounted in a seat 178 formed in the lower end of guide 120 for engaging the pair of rods. The upper end of the pad is formed with T-shaped head 180 which slides into a corresponding T-shaped key slot 182 molded in the guide. The pad is made of a suitable resiliently deformable material having frictional properties, such as the synthetic polymer sold under the trademark Krayton. The lower end of the pad is formed with fingers 184 which deform about the rods, as illustrated in FIG. 12, for enhancing the gripping action. This construction also permits a single pad to be universally used for accommodating a range of peg hook sizes.

Figure 11:
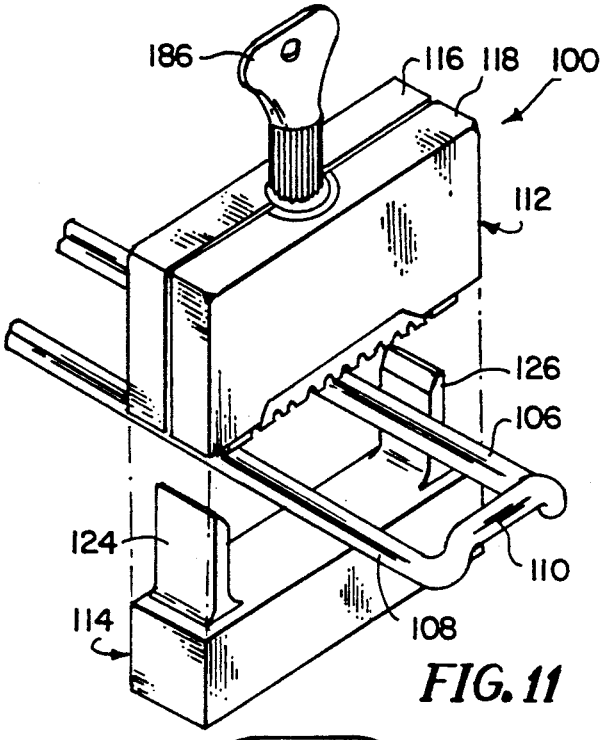
FIG. 11 is a view similar to FIG. 10 showing components of the device unlocked from the safety hook.
Figure 13:
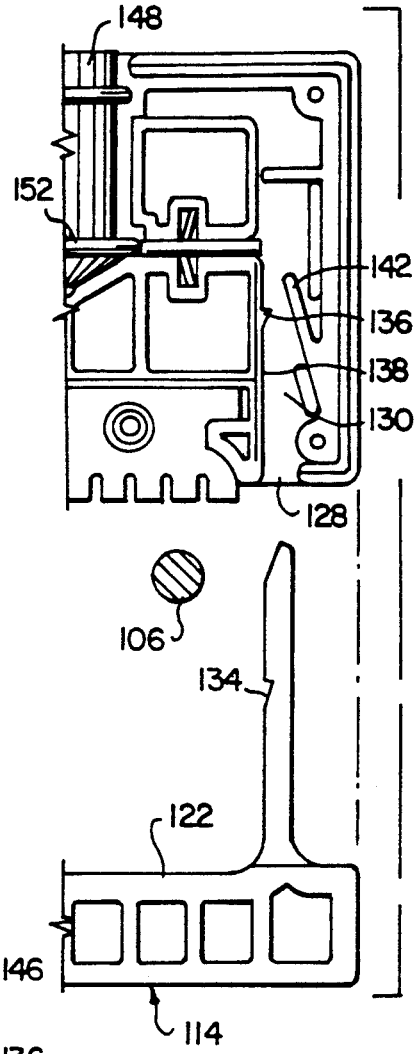
FIG. 13 is a view similar to FIG. 12 showing components of the security device in their fully unlocked positions.

In the operation of security device 100, the first step is to hold housing 112 above the hook rods with latch 114 aligned below as shown in FIGS. 11 and 13. As the latch is pushed upwardly the tines enter the housing passageways and are cammed outwardly as the bevelled surfaces at their tips strike the detent nibs. This causes fingers 140 and 142 to flex outwardly until notches 132, 134 come into alignment with the detent nibs, as shown in FIG. 12. Responding to the force applied by the fingers, the tines snap inwardly with the notches engaging the nibs in the fully locked position shown in FIG. 12. As the latch is moved to its fully inserted position, capture bar 122 presses the rods upwardly against pad 176 which resultantly deforms about the rods to create a secure grip.

A key 186 is used to turn cylinder 148 so that the cam tracks are moved to their locking positions. At this point the low rises of the cam tracks are in alignment with cam follower springs 156, 158. The forces released from the elastic memory of the wings causes the wings to return to their inclined positions, thereby urging the spring bodies inwardly so that they remain in contact with the cam tracks.

The security device is unlocked by turning the key so that the cylinder moves the high rise portions of the cam tracks into alignment with the cam follower springs. The springs are moved outwardly by the cam tracks, and the outer ends of the springs in turn move the tines outwardly to their unlocked positions of FIGS. 15 and 16. The forces from the elastic memory of arms 144 and 146 are then released to act downwardly against the tines for initially moving the latch out of the housing. The latch can then be fully withdrawn to remove the device from the safety hook.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. A security device for releasably securing merchandise products onto a hook of the type having one or more elongate rods for mounting on a pegboard or other support, the device comprising the combination of a housing having an opening at one end thereof; rod-engaging means carried by the housing for seating against and engaging one side of at least one of the rods; a latch having a pair of spaced-apart tines sized for slidable movement through the opening toward and away from respective fully-inserted positions within the housing, the latch including a capture bar extending between the tines with the capture bar positioned to seat against an opposite side of said rod(s) and hold the rod(s) against the rod-engaging means when the tines are at said fully-inserted positions in the housing; lock means selectively operable for locking the tines within the housing responsive to the tines being at said fully-inserted positions whereby unintended withdrawal of the tines is prevented; lock release means for selectively unlocking the tines to enable withdrawal of the latch from the housing and to release the capture bar from the rod(s) whereby the device is released from the hook to permit removal of one or more of the products therefrom, said tines being formed of a resilient flexible material whereby the tines resiliently flex responsive to an applied force; the lock means includes finger means positioned in the paths of movement of the tines into the opening for applying a force against and resiliently flexing the tines sideways of their direction of movement, said lock means further including detent means carried by the housing for engaging the tines responsive to said sideways flexing for releasably holding the tines against movement away from their fully-inserted positions.

2. A security device as in claim 1 in which the detent means includes a detent carrier body mounted in the housing between the tines when they are inserted into the housing opening; detent nibs carried by the body to project into the paths of movement of the tines; said detent means includes means defining notches in the sides of the tines which face the carrier body, said notches being positioned to releasably seat and hold respective nibs when the tines are in their fully-inserted positions.

3. A security device as in claim 2 which includes means on the distal ends of the tines defining inclined surfaces for camming against the nibs to flex the tines in directions away from the nibs to permit the tines to move along the nibs until the nibs are received in the notches.

4. A security device as in claim 1 in which the lock release means includes a cam having a cam track; means for mounting the cam in the housing; and operating means for moving the cam track to an unlocking position for camming the tines to positions in which they disengage from the detent means, said operating means further moving the cam track to a locking position enabling the detent means to engage the tines.

5. A security device as in claim 4 for use in securing products on safety hooks of the type having a pair of elongate rods arranged in laterally spaced-apart relationship, further characterized in that said rod-engaging means is seated against said one side of each of the rods, and the capture bar is positioned to seat against said opposite sides of each of the rods; and including cam follower means mounted in juxtaposition with the cam for camming the tines responsive to said movement of the cam track.

6. A security device as in claim 4 in which the lock release means includes a cylinder having a rim which carries the cam track; means for mounting the cylinder for rotation in the housing at a position where the cam track is in juxtaposition with the tines; said operating means including means for selectively rotating the cylinder for moving the cam track between its unlocking and locking positions.

7. A security device as in claim 6 for use in securing products on safety hooks of the type having a pair of elongate rods arranged in laterally spaced-apart relationship, further characterized in that said rod-engaging means is seated against said one side of each of the rods, and the capture bar is positioned to seat against said opposite sides of each of the rods; and including cam follower means mounted in juxtaposition with said rim of the cylinder for camming the tines responsive to said movement of the cam track.

8. A security device as in claim 6 in which the means for selectively rotating the cylinder includes a keyway in the cylinder, said keyway having an end which is accessible from outside the housing; key means sized commensurate with the keyway for insertion therein and for manually rotating the cylinder for moving the cam track between its unlocking and locking positions.

9. A security device as in claim 1 which includes resilient flexible arm means which is bent to a cocked position responsive to insertion of the tines within the housing and with the arm means in their cocked position applying a force against the tines for at least partially moving the latch out of the opening when the tines are unlocked.

* * * * *